US011932292B2

(12) United States Patent
Kurz et al.

(10) Patent No.: US 11,932,292 B2
(45) Date of Patent: Mar. 19, 2024

(54) VEHICLE AND ROUTE MONITORING SYSTEM

(71) Applicant: Transportation IP Holdings, LLC, Norwalk, CT (US)

(72) Inventors: Brian Kurz, Thurmont, MD (US); Richard S. Klemanski, Walkersville, MD (US); Padam Dhoj Swar, Clarksburg, MD (US); Carl L. Haas, Walkersville, MD (US); Daniel McGee, Alexandria, VA (US); James Cowan, Pittsburgh, PA (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 268 days.

(21) Appl. No.: 17/550,026

(22) Filed: Dec. 14, 2021

(65) Prior Publication Data

US 2023/0182789 A1 Jun. 15, 2023

(51) Int. Cl.
*B61L 15/00* (2006.01)
*B61L 27/70* (2022.01)

(52) U.S. Cl.
CPC ..... *B61L 15/0018* (2013.01); *B61L 15/0054* (2013.01); *B61L 27/70* (2022.01)

(58) Field of Classification Search
CPC .. B61L 15/0018; B61L 15/0054; B61L 27/70; B61L 3/127; B61L 15/0027
See application file for complete search history.

(56) References Cited

U.S. PATENT DOCUMENTS 6,456,674 B1 * 9/2002 Horst ..... H04L 1/02 375/259
2004/0117073 A1 * 6/2004 Horst ..... B61L 17/00 701/19
2004/0131112 A1 * 7/2004 Horst ..... B61L 3/127 375/222

FOREIGN PATENT DOCUMENTS

CA 2248526 A1 * 3/2000 ..... H04L 1/02
EP 1165356 B1 * 8/2003 ..... B61L 17/00
EP 1344704 A1 * 9/2003 ..... B61L 17/00

* cited by examiner

*Primary Examiner* — Hung Q Nguyen
(74) *Attorney, Agent, or Firm* — The Small Patent Law Group LLC; Josef L. Hoffmann

(57) ABSTRACT

A system is provided that may include a first communication controller that may communicate with a vehicle system formed from two or more vehicles. The first communication controller may operate in different modes, including a first mode to control movement of the vehicle system without repeating any control signals communicated between the vehicles, and in a second mode to monitor different frequencies for receipt of the control signals, receive and repeat a first control signal of the control signals at a first frequency, and receive and repeats a second control signal of the control signals at a second frequency. The first communication controller may also operate in a third mode in which the first communication controller may monitor the first frequency but not the second frequency for the first control signal, receives the first control signal at the first frequency, and repeats the first control signal at the first frequency.

20 Claims, 4 Drawing Sheets

VEHICLE AND ROUTE MONITORING SYSTEM

BACKGROUND

Technical Field

The subject matter described herein relates to a communication system.

Description of the Art

For certain vehicle systems that include numerous individual vehicles, or are exceptionally long, communication can be problematic. For example, a rail vehicle may have one hundred individual cars, where the controller operated by the vehicle operator can be a head of train (HOT) controller located in the first car and needs to communicate with an end of train (EOT) controller on the last car. Often an EOT controller is responsible for emergency braking of the vehicle system. In particular, depending on a route, a first vehicle at the front of a vehicle system may be around a curve and in a tunnel, while a second vehicle of the vehicle system may be located on a straightaway of the route and outside of the tunnel. The different positions of these vehicles can interfere with communication between the vehicles. Thus, a clear communication pathway along the vehicle system is desired for the safe functioning of the vehicle, where the length of a vehicle may cause communication problems.

In other vehicle systems, communication similarly may be important between individual vehicles of the vehicle system. For example, a fleet of automobiles may be employed as a taxi service in a downtown area, where communication between vehicles is important for picking up potential passengers. However, downtown areas can include numerous large buildings that can block the communication pathways between the individual vehicles. As a result confusion can occur, leading to double booking, a passenger not being picked up, or the like. Consequently, having clear communication between vehicles of a vehicle system is desired.

BRIEF DESCRIPTION

In accordance with one embodiment, a system is provided that may include a first communication controller configured to communicate with a vehicle system formed from two or more vehicles. The first communication controller may operate in different modes, including a first mode in which the first communication controller operates to control movement of the vehicle system without repeating any control signals communicated between the vehicles. The first communication controller may also operate in a second mode in which the first communication controller monitors different frequencies for receipt of the control signals, receives and repeats a first control signal of the control signals at a first frequency, and receives and repeats a second control signal of the control signals at a second frequency. The first communication controller may also operate in a third mode in which the first communication controller may monitor the first frequency but not the second frequency for the first control signal, receives the first control signal at the first frequency, and repeats the first control signal at the first frequency.

In accordance with one embodiment, a method may be provided that includes operating a first communication controller in a first mode to control movement of a vehicle system formed from two or more vehicles without repeating any control signals communicated between the vehicles. The method may also include operating the first communication controller in a second mode to monitor different frequencies for receipt of the control signals, to receive and repeat a first control signal of the control signals at a first frequency, and to receive and repeat a second control signal of the control signals at a second frequency. The method may also include operating the first communication controller in a third mode to monitor the first frequency but not the second frequency for the first control signal, to receive the first control signal at the first frequency, and to repeat the first control signal at the first frequency.

In accordance with one embodiment, a system is provided that may include a first communication controller that may communicate with a vehicle system formed from two or more vehicles. The first communication controller may operate in different modes, the modes including a first mode in which the first communication controller operates to control movement of the vehicle system without repeating any control signals communicated between the vehicles. The modes may also include a second mode in which the first communication controller monitors different frequencies for receipt of the control signals, receives and repeats a first control signal of the control signals at a first frequency, receives and repeats a second control signal of the control signals at a second frequency, and monitors an identification frequency. The modes may additionally include a third mode in which the first communication controller monitors the first frequency but not the second frequency for the first control signal, receives the first control signal at the first frequency, repeats the first control signal at the first frequency, and monitors the identification frequency.

BRIEF DESCRIPTION OF THE DRAWINGS

The inventive subject matter may be understood from reading the following description of non-limiting embodiments, with reference to the attached drawings, wherein below.

DETAILED DESCRIPTION

The subject matter described herein relates to a system and method for communicating a control signal for a vehicle system. In a vehicle system, such as a rail vehicle system that may have numerous vehicles, often control signals are broadcast from a communication device of a first or head vehicle to a second or end vehicle. Control signals may include communication signals, operation signals, or another signal that may be wirelessly passed from one vehicle to another vehicle of a vehicle system. Because of the length of such vehicle systems, coupled with traveling through tunnels, around mountains, around buildings, etc. the control signals can lose signal strength, be blocked, or the like. As a result, first and second communication controllers located between the first communication device and second communication device are utilized as repeaters for rebroadcasting control signals when each communication controller is not operating for its intended use.

In an instance when a first frequency is used to broadcast a first command signal and a second frequency is used to communicate a second command signal, the first and second communication controllers communicate with one another such that the first communication controller monitors and repeats the first command signal at the first frequency, and the second communication controller monitors and repeats the second command signal at the second frequency. The first communication controller may also broadcast a first identification signal, while monitoring and receiving a second identification signal that is broadcast by the second communication controller. The first communication controller and second communication controller then coordinate with one another so that the first communication controller monitors and repeats at a first frequency, and the second communication controller monitors and repeats at a second frequency.

The first communication controller continues operating in this mode until no longer receiving the second identification signal for a determined period. In particular, when the second communication control stops functioning as a repeater for any reason, the second identification signal is no longer broadcast. Consequently, when the second identification signal is not received for the determined period, the first communication controller switches modes to monitor and repeat control signals at the first frequency and the second frequency.

Figure 1:
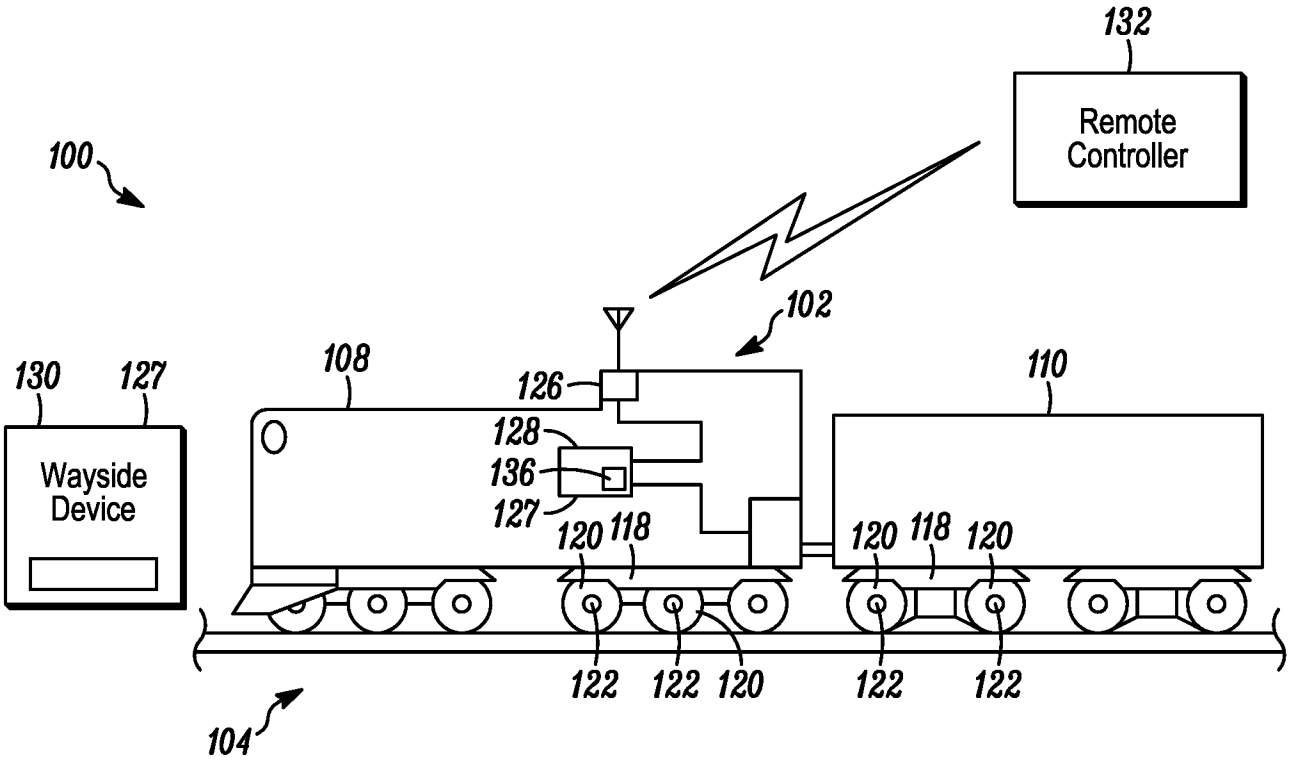
FIG. 1 is a schematic view of a vehicle system.

FIG. 1 illustrates a schematic diagram of one example of a vehicle system 100. While FIG. 1 illustrates the vehicle system as a rail vehicle system, in other examples, the vehicle system can include automobiles, marine vessels, airplanes, off road vehicle, construction vehicles, vehicles in a fleet, or the like. In particular, a vehicle system may include a single vehicle or two or more vehicles. The vehicle system may travel along a route 104 on a trip from a starting or departure location to a destination or arrival location. The vehicle system includes a propulsion-generating vehicle 108 and a non-propulsion-generating vehicle 110 that are mechanically interconnected to one another to travel together along the route. The vehicle system may include at least one propulsion-generating vehicle and optionally, one or more non-propulsion-generating vehicles. Alternatively, the vehicle system may be formed of only a single propulsion-generating vehicle.

The propulsion-generating vehicle may generate tractive efforts to propel (for example, pull or push) the vehicle system along routes. The propulsion-generating vehicle includes a propulsion system, such as an engine, one or more traction motors, and/or the like, that operate to generate tractive effort to propel the vehicle system. Although one propulsion-generating vehicle and one non-propulsion-generating vehicle are shown in FIG. 1, the vehicle system may include multiple propulsion-generating vehicles and/or multiple non-propulsion-generating vehicles. In an alternative embodiment, the vehicle system only includes the propulsion-generating vehicle such that the propulsion-generating vehicle is not coupled to the non-propulsion-generating vehicle or another kind of vehicle. In yet another embodiment, the vehicles in the vehicle system are logically or virtually coupled together, but not mechanically coupled together.

In the example of FIG. 1, the vehicles of the vehicle system each include multiple wheels 120 that engage the route and at least one axle 122 that couples left and right wheels together (only the left wheels are shown in FIG. 1). Optionally, the wheels and axles are located on one or more trucks or bogies 118. Optionally, the trucks may be fixed-axle trucks, such that the wheels are rotationally fixed to the axles, so the left wheel rotates the same speed, amount, and at the same times as the right wheel. In one embodiment, the vehicle system may not include axles, such as in some mining vehicles, electric vehicles, etc.

The vehicle system may also include a communication system 126 that can include on or more communication controllers 127. The communication controllers may be one or more vehicle controllers 128, and/or one or more wayside devices 130. In the vehicle system of FIG. 1, a vehicle controller is illustrated on the first vehicle of the first vehicle system. In one example, the vehicle controller may be a HOT vehicle controller. The HOT vehicle controller may be in communication with numerous operating systems of the vehicle system including an engine, throttle, axles, bearing systems, braking system, or the like. The HOT vehicle controller may be located on the first vehicle of a vehicle system, the last vehicle of the vehicle system, or any other vehicle of the vehicle system. In another example, a vehicle controller may be an EOT vehicle controller. To this end, in one example, the EOT vehicle controller may be coupled to and operate an emergency braking system of the vehicle system. An EOT vehicle controller may be on the last vehicle of a vehicle system, or alternatively, may be on any other vehicle of the vehicle system. In example embodiments the vehicle system may include both a HOT vehicle controller and an EOT vehicle controller.

In other example embodiments, the vehicle controller may neither be a HOT nor EOT vehicle controller. Instead, the vehicle controllers may be vehicle controllers that are in a vehicle such as a locomotive that is in the middle of the vehicle system. In another example, the vehicle controller may be a HOT vehicle controller or EOT vehicle controller, but be located on a vehicle in the middle of the vehicle system. In addition, the control system may include one vehicle controller, two vehicle controllers, five vehicle controllers, ten vehicle controllers, or the like.

In yet other example embodiment, a vehicle system such as a fleet of ships, a fleet of automobiles, a fleet of aircraft, a fleet of mining vehicles, etc. may be presented that do not have HOT or EOT controllers. Instead, each individual vehicle in the vehicle system may have their own vehicle controller that is a communication controller and part of the communication system.

The control system may also include the wayside device that may be a communication controller that may receive and repeat control signals when the vehicle system is in the vicinity of the wayside device. In particular, when the wayside device is between a first communication device and a second communication device, the wayside device may be part of the communication system. The wayside device may be any device that is not located on the vehicle system and includes functionality to receive and repeat control signals. The wayside device may be a crossing device, battery recharging device, traffic signal device, dispatch device, maintenance controller device, or the like. Each wayside device may communicate within the communication system to receive and repeat control signals as a communication controller.

In all, the communication system is made of a first communication device that is broadcasting command signals to a second communication device, and the communication controllers (e.g. vehicle controllers, wayside devices, communication devices, etc.) between the first communication device and second communication device that can receive and repeat control signals at different frequencies. One or more processors can execute directions to determine the quality of communication equipment of each communication controller, availability of each communication controller, or the like, to determine which communication controllers monitor and repeat control signals at each frequency to improve overall communication quality.

In one example embodiment, at least one vehicle controller allows wireless communications between the vehicles and/or remote locations, including with a remote controller 132. The remote controller may be a dispatch controller, maintenance controller, or the like. The remote controller may include a receiver and a transmitter, or a transceiver that performs both receiving and transmitting functions. The remote controller may also include an antenna and associated circuitry.

Figure 2:
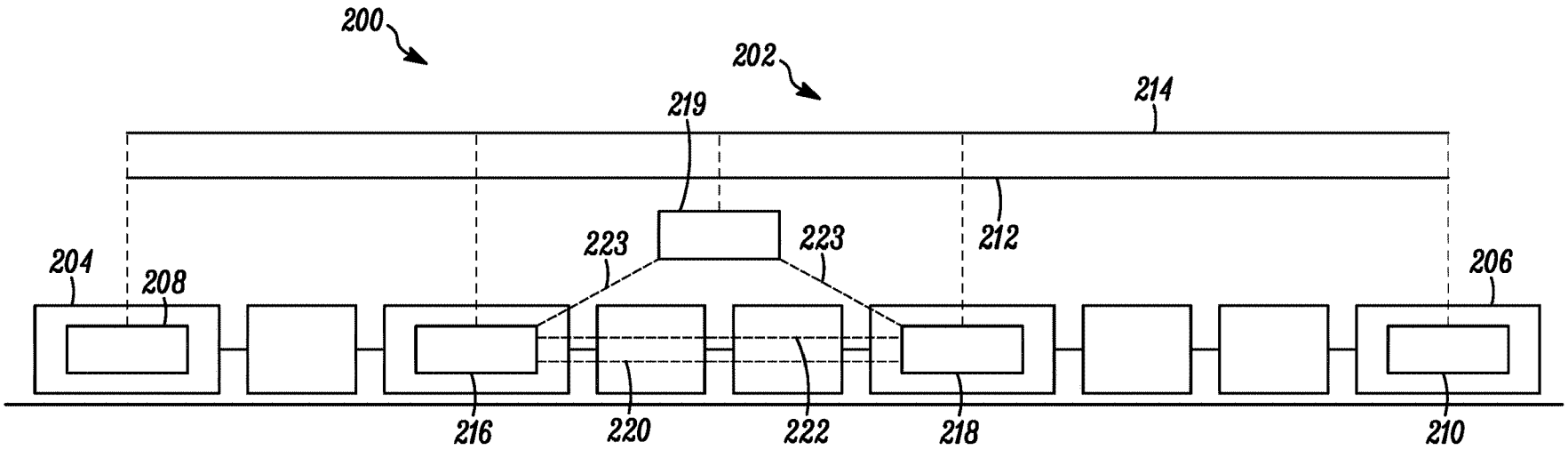
FIG. 2 is a schematic view of a vehicle system.

FIG. 2 illustrates a schematic illustration of a vehicle system 200 that utilizes a communication system 202 for communicating between a front end 204 of the vehicle system and the back end 206 of the vehicle system. In one example, the vehicle system is the vehicle system of FIG. 1. In another example, the vehicle system is a rail vehicle system. The individual vehicles of the vehicle system may be mechanically coupled, logically coupled, virtually coupled, or the like. The individual vehicles may be propulsion vehicles, non-propulsion vehicles, etc.

The communication system can include a first communication device 208 that is located at the first individual vehicle, that may communicate with a second communication device 210 that is located at the last individual vehicle of the vehicle system. In examples, the communication devices are radio systems, Wi-Fi systems, cellular systems, or the like. In one example, the first communication device may be a HOT vehicle controller of a rail vehicle. In another example, the second communication device may be a EOT vehicle controller of a rail vehicle. The first communication device and second communication device may communicate with one another at a first frequency 212 and/or a second frequency 214, and/or other frequencies.

The communication system may also include a first communication controller 216 and second communication controller 218 each located on an individual vehicle between the first vehicle and last vehicle of the vehicle system. In one example, the first communication controller may be a HOT vehicle controller, EOT vehicle controller, auxiliary locomotive vehicle controller, or the like. Similarly, the second communication controller may be a HOT vehicle controller, EOT vehicle controller, auxiliary locomotive vehicle controller, or the like. In other examples, the communication controllers are neither HOT nor EOT devices. In other examples when the vehicle system is a fleet of vehicles such as automobiles, mining vehicles, watercraft, aircraft, etc. each individual vehicle has a vehicle controller that is a communication controller. In this manner, a first vehicle has the first communication controller, a second vehicle has the second communication controller, etc.

The communication system may also include a third communication controller 219 that is remote from the vehicle system. In one example, the third communication controller may be a wayside device located next to a route of a vehicle system. In another example, the third communication controller could be a dispatch controller, maintenance controller, or the like that is located to provide control signals to be repeated by the third communication controller.

In one example, each of the communication controllers may have a first mode, second mode, and a third mode. In a first mode the communication controller operates to control movement of the vehicle system without repeating any control signals communicated between the vehicles. To this end, the communication controller may include a primary function, such as receiving inputs from an operator to control one or more operating systems of the vehicle system. In one example, the communication controller is a vehicle controller that in the first mode may be utilized to set the throttle, braking, etc. of a rail vehicle system. Alternatively, in the second mode and third mode, the communication controller may function as a repeater. A repeater is a device that monitors for a control signal and upon receiving a control signal, repeats the signal. As a control signal travels from a broadcasting device to a final receiving device, the control signal loses strength, can be interfered with, blocked, or the like, causing difficulties in communication. A repeater device is located between the broadcasting device and final receiving device, and upon receiving a control signal repeats the broadcasting of the control signal, thus providing a stronger signal strength at a point closer to the final receiving device. Consequently, the communication pathway is improved.

In one example, in the second mode, the first communication controller monitors different frequencies for receipt of control signals, receives and repeats a first control signal at a first frequency, and receives and repeats a second control signal at a second frequency. To this end, the communication controller functions as a repeater that monitors for both control signals at a first frequency, and for control signals at a second frequency. As a result, the first communication controller monitors both for the first frequency and the second frequency.

In a third mode, a communication controller monitors the first frequency but not the second frequency for the first control signal, receives the first control signal at the first frequency, and repeats the first control signal at the first frequency. In the third mode, the first communication controller identifies an additional communication controller (e.g. a second communication controller, third communication controller, etc.) that can also function as a repeater. As a result, the first communication controller may communicate with the identified second or third communication controller such that the first communication controller only monitors for control signals at the first frequency, while another communication controller monitors only for control signals at the second frequency. In this manner, when a communication controller only monitors for a first frequency and does not monitor for a second frequency, the communication controller is operating in the third mode.

While in this example embodiment, the primary mode is referred to as the first mode, the term "first mode" does not connote primary operation. To this end, one could consider the mode when both frequencies are monitored by the first communication controller to be a first mode, the mode when only one frequency is monitored by the first communication controller to be a second mode, and the primary (e.g. non-repeater functionality) mode of the first communication controller to be a third mode.

Switching between modes may occur automatically. For example, the first communication controller may automatically start operating in a first mode that is a primary mode. When the first communication controller is a first vehicle controller, the first vehicle controller can then monitor for inputs from an operator, and after each input, a period of time may start. If a threshold period of time is reached without an operator providing an additional input, the communication controller may switch from operating in the first mode to operating in a second mode where the first communication controller functions as a repeater for two or more frequencies. In examples, the threshold period may be thirty seconds, one minute, two minutes, five minutes, ten minutes, etc. Therefore, if an operator provides no inputs for the threshold period, the first communication controller may automatically switch to operating in the second mode. The first communication controller may remain in the second mode until an operator provides an input to the first communication controller. When receiving an input, the first communication controller automatically switches from the second mode of operation to the primary mode (e.g. first mode in this example) to function for its intended purpose. Once the input is provided, the first communication controller again can provide a threshold period and switch back to the second mode upon reaching the threshold period.

In addition, the first communication controller may also switch from the second mode a third mode. When in the second mode, the first communication controller may broadcast a first identification signal 220 while monitoring for a second identification signal 222 from the second communication controller or a third identification signal 223 from the third communication controller.

The first identification signal, second identification, and/or third identification signal may include data and information including vehicle controller identification such as a name or location, a wayside identifier, a default frequency, communication equipment and capabilities available, or the like, that may be utilized by a receiving communication controller for switching modes. In particular, the data and information, such as communication equipment and capabilities may be utilized by the communication controllers to determine which communication controllers repeat command signals in particular frequencies. Once another communication controller is identified, the first communication controller and other communication controllers may work together so that one monitors for, and repeats first command signals at a first frequency while another monitors for and repeats second command signals at the second frequency.

Each communication controller may repeatedly monitor for the identification signals of the other communication controllers to ensure repeating at the first frequency and the second frequency is always occurring. If a determined period of time lapses without receiving an identification signal from another communication controller, a communication controller may switch from a third mode where only one frequency is monitored, to the second mode where both a first frequency and second frequency are monitored.

Figure 3:
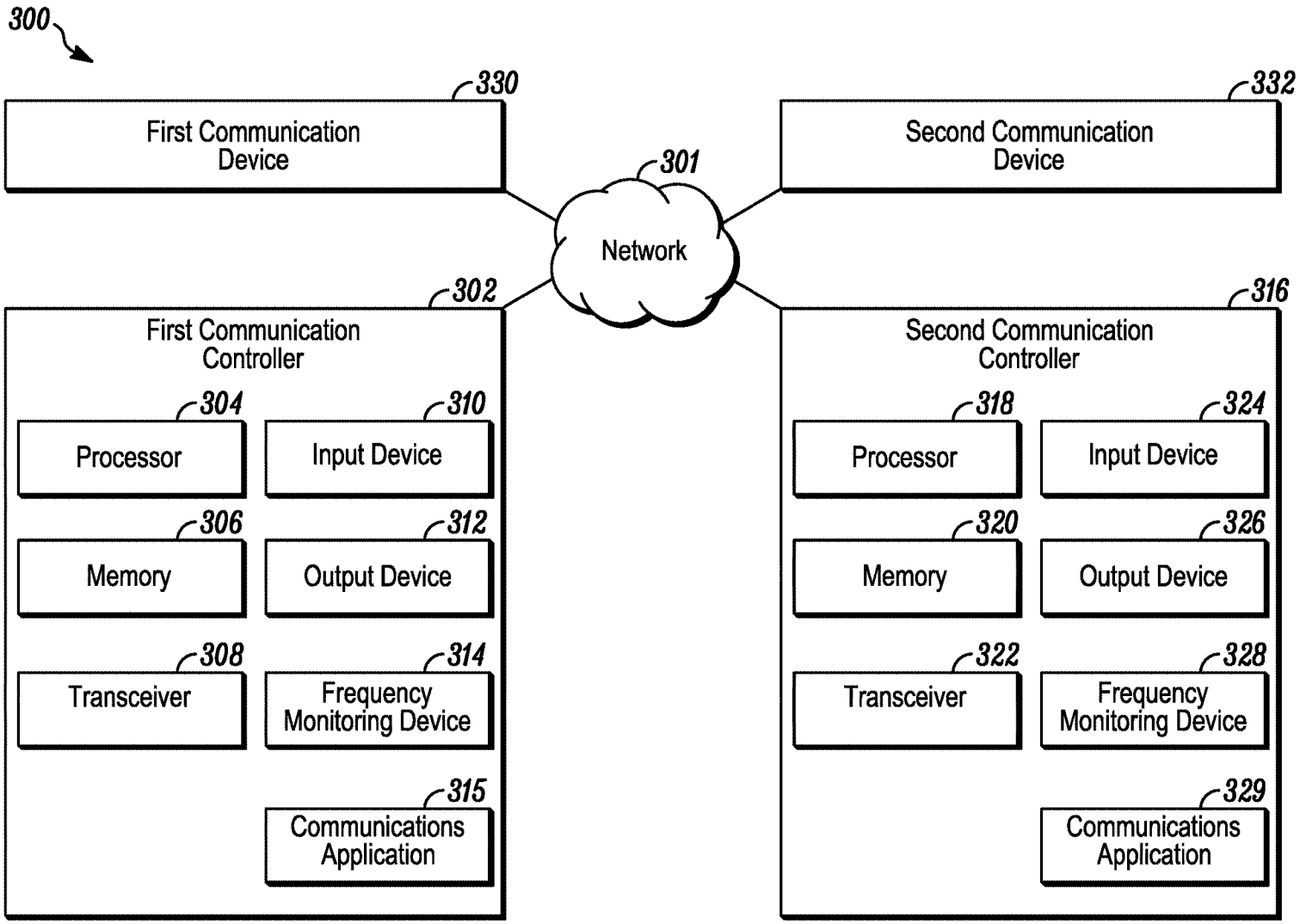
FIG. 3 is a schematic view of a communications system.

FIG. 3 is a schematic illustration of a control system 300 of a vehicle system. The vehicles systems can include automobiles, rail vehicles, marine vessels, airplanes, off road vehicles, construction vehicles, vehicles in a fleet, or the like. In an example, the control system may communicate through a network 301. In one example, the control system includes a first communication controller 302 that in one example is the vehicle controller of FIG. 1. In another example, the first communication controller is a communication controller in FIG. 2. In yet another example, the first communication controller is a HOT vehicle controller. In still yet another example, the first communication controller may be on a vehicle of the vehicle system that is between the first vehicle of the vehicle system and the last vehicle of the vehicle system. In yet another example, the first communication controller can be a wayside device controller.

The first communication controller includes one or more processors 304 (microprocessors, integrated circuits, field programmable gate arrays, etc.). The one or more processors may receive location data, operating data from operation systems, or the like. The first communication controller may also include a memory 306, which may be an electronic, computer-readable storage device or medium. The first communication controller memory may be within the housing of the first communication controller, or alternatively may be on a separate device that may be communicatively coupled to the first communication controller and the one or more processors therein. By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. The first communication controller memory can include a tangible, non-transitory computer-readable storage medium that stores data on a temporary or permanent basis for use by the one or more processors. The memory may include one or more volatile and/or non-volatile memory devices, such as random access memory (RAM), static random access memory (SRAM), dynamic RAM (DRAM), another type of RAM, read only memory (ROM), flash memory, magnetic storage devices (e.g., hard discs, floppy discs, or magnetic tapes), optical discs, and the like. The memory may then be used by the one or more processors to access data for making determinations related to different modes of operation of the first communication controller.

The first communication controller may also include a transceiver 308 that may communicate with other communication controllers and remote controllers including dispatch controllers, maintenance controllers, etc. The transceiver may be a single unit or be a separate receiver and transmitter. In one example, the transceiver may only transmit signals, but alternatively may send (e.g., transmit and/or broadcast) and receive signals.

The first communication controller may also include an input device 310 and an output device 312. The input device may be an interface between an operator, or monitor, and the one or more processors. The input device may include a display or touch screen, input buttons, ports for receiving memory devices, etc. In this manner, an operator may manually provide parameters into the controller, including vehicle parameters, route parameters, and trip parameters. Similarly, the output device may present information and data to an operator, or provide prompts for information and data. The output device may similarly be a display or touch screen. In this manner, a display or touch screen may be an input device and an output device.

The first communication controller may also include a frequency monitoring device 314 that monitors different frequencies for control signals. In one example, the frequency monitoring device monitors for a first frequency and monitors for a second frequency. The frequency monitoring device may be controlled by the one or more processors to operate in a first mode, second mode, or third mode.

In a first mode, the frequency monitoring device monitors for a first frequency while also monitoring for a second frequency. Specifically, the first frequency has a different frequency than the second frequency.

In a second mode, the frequency monitoring device monitors only the first frequency, or the second frequency. In the second mode, when monitoring at the first frequency, the frequency monitoring device does not monitor at the second frequency. Similarly, when in the second mode, when monitoring at the second frequency, the frequency monitoring device does not monitor at the first frequency. Instead, only one frequency is monitored in the second mode.

Meanwhile, in the third mode, the frequency monitoring device simply does not monitor for a command signal at any frequency. The one or more processors determine when to switch between the first, second, and third modes to ensure the first communication controller is functioning for its primary purpose, and is providing the best communication by working with additional communication controllers to repeat command signals.

The first communication controller may also include a communications application 315 that may include instructions for operating the first communication controller in a first mode, second mode, and third mode. The communication application may cause the first communication controller to communicate with other communication controllers to receive data and information from the other communication controllers. The information and data may include the location of the other communication controller, the type of communication capabilities and equipment of the other communication controller, the bandwidth or functionality of the other communication controller, or the like. In this manner, the first communication controller can make determinations related to the best way to communicate a command signal along a communication pathway.

For example, the first communication controller may receive data or information that another communication controller has better communication equipment than the first communication controller. As a result, a determination can be made to have the other communication controller function as a repeater at a first frequency that requires more equipment for such repeating. Alternatively, a determination may be made that another communication controller cannot repeat communications at first frequency, second frequency, etc. Therefore, the other communication controller is only utilized for repeating in the frequency the other communication controller is able to repeat, while the first communication controller repeats control signals at the other frequency.

The control system may also include a second communication controller 316 that is in communication with the first communication controller. In one example, the second communication controller is an EOT vehicle controller. Alternatively, the second communication controller may be a HOT vehicle controller. In yet another example the second communication controller is a wayside device controller. The second communication controller can include one or more processors 318 (microprocessors, integrated circuits, field programmable gate arrays, etc.), a memory 320, which may be an electronic, computer-readable storage device or medium, a transceiver 322 that may communicate with the monitoring controller, an input device 324, an output device 326, a frequency monitoring device 328, and communications application 329. The second communication controller and the components operate in a similar manner as the first communication controller.

The control system may also include a first communication device 330 and a second communication device 332. The first communication device in one example may be located on the first vehicle of a vehicle system while the second communication device may be located on the last vehicle of a vehicle system. Alternatively, the first communication device may be located on another vehicle other than the first vehicle of the vehicle system, while the second communication device may similarly be located on a different vehicle than the last vehicle of the vehicle system. The first communication device and second communication device may each be a communication controller that includes one or more processors, a memory, transceiver, etc. In one example the first communication device may be a HOT vehicle controller while the second communication device may be an EOT vehicle controller. Alternatively, one or both of the first communication device and second communication device may not have one or more processors, or a memory. Instead, one or both of the first and second communication devices may have functionality to broadcast and receive control signals at multiple frequencies.

Figure 4:
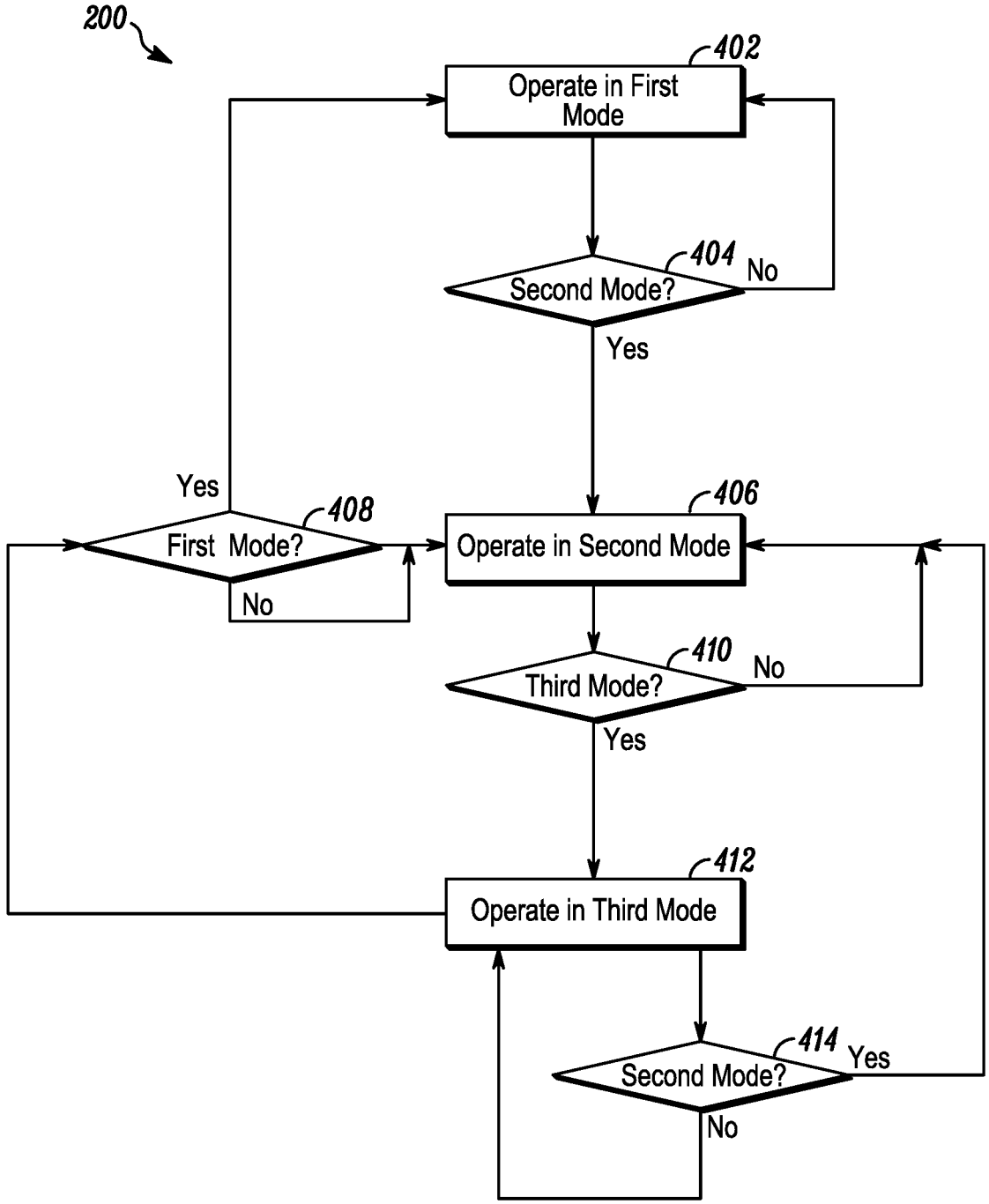
FIG. 4 is a block flow diagram of a method of communicating a control signal along a vehicle system.

FIG. 4 illustrates a process 400 for communicating a control signal from a vehicle system. In one example, the method may be performed by one or more of the communication controllers described in relation to FIGS. 1, 2, and/or 3. In another example, the vehicle system may be one of the vehicle systems of FIGS. 1 and 2. The method may be performed when a control signal is communicated between two communication devices and at least two communication controllers located between the two communication devices. As used herein the term "between" does not refer to a physical straight pathway from a first communication device to a second communication device; instead, any communication controller that receives a control signal from a first communication device before the control signal is received by the second communication device may be considered between the first communication device and second communication device. The communication devices in one example may also be vehicle controllers. The vehicle system may be a rail vehicle system, a fleet of automobiles, a fleet of aircraft, a fleet of ships, or the like.

At step 402, a first communication controller operates in a first mode, and does not monitor for at first frequency or a second frequency. In one example, the first communication controller is a HOT vehicle controller. In another example, the first communication controller is an EOT vehicle controller. In yet another example, the first communication controller is a wayside device controller. In another example, the first communication controller is located on a vehicle of a vehicle system that is between two vehicles that each have a communication device.

In one example, in the first mode of operation, the first communication controller receives inputs from an operator. The inputs may include throttle settings, brake settings, trip plans, or the like. In particular, the first communication controller is operating for its intended purpose. In one example, the first communication controller is a first vehicle controller, and the intended purpose of the first vehicle controller is to operate one or more operating systems of the vehicle system. The operating systems may include an engine, braking system, cooling system, bearing system, axles, or the like.

At step 404, a determination may be made whether the first communication controller should switch from operating in a first mode to a second mode. In one example, in the second mode, the first communication controller functions as a repeater for control signals communicated between a first communication device and second communication device. In the second mode, the first communication controller may function to monitor for control signals in at least a first frequency and at a second frequency.

In one example, to make the determination an operator may provide a manual input that places the first communication controller in the second mode. In another example, a trip plan may exist where operating in a second mode automatically occurs at a determined location, milage, vehicle speed, or the like. In yet another example, a determined period, or threshold period may be provided based on non-use of the first communication controller for its intended purpose. In one example, if a vehicle operator does not provide an input to the first communication controller for the determined period of thirty seconds, the first communication controller may automatically switch to the second mode of operation. While in one example the determined period may be thirty seconds, in another example the determined period may be ten seconds, one minute, five minutes, ten minutes, etc. In another example, one or more processors of the first communication controller may make a determination related to the determined period based on numerous factors, including time since last input, trip plan, current location, loss of signal detected, etc. For example, a rail vehicle system may have a determined period of two minutes; however, if the rail vehicle is traveling through a tunnel and a weak, or no control signal is detected, the one or more processors may drop the determined period to thirty seconds to prioritize repeating the control signal. In this manner, the determined period may be dynamically varied during a trip based on characteristics, parameters, conditions, etc. of the trip. The determination to dynamically vary the determined period in one example may include utilization of an algorithm, an artificial intelligence algorithm, machine learning algorithm, or the like.

If a determination is made that the mode should not switch, then the first communication controller simply continues operating in a first mode. However, if a determination is made that a switch should occur, then at step 406 the mode of the first communication controller is switched from operating in a first mode to operating in a second mode.

At step 408, when in the second mode, a determination is made whether the first communication controller should switch back into the first mode. In particular, the first communication controller repeatedly monitors to ensure the first communication controller does not need to be functioning for its intended purpose. In one example, an input is provided to the first communication controller. The input may be provided by an operator, another communication controller, a vehicle controller, a wayside device, a remote controller, or the like. As a result, the first communication controller automatically stops monitoring for control signals at a first frequency and a second frequency and executes instructions based on the input(s) provided. Alternatively, the one or more processors may make a determination based on a trip plan, location, sensor reading, weather change, etc. that the first communication controller should switch back to operating in the first mode. In a first example, when a vehicle system nears a destination, switch point, location with a change in a speed limit, a populated area, or the like, the first communication controller may automatically switch from the second mode to the first mode. Alternatively, an operating condition, such as a hot engine, hot axle, etc. may occur that requires inputs from a vehicle operator, resulting in switching from the second mode back to the first mode. Thus, if a determination is made that the first communication controller should be operating in the first mode, the first communication controller switches back to operating in the first mode.

At step 410, in addition to determining whether the communication controller should switch back into the first mode, a determination is also made whether the communication controller should switch from the second mode to a third mode. In one example, the first communication controller broadcasts a first identification signal while monitoring for a second identification signal broadcast by a second communication controller. If more than one communication controller is located between the first communication device and second communication device, both may function as repeaters for control signals at the first frequency and the second frequency. Because monitoring and repeating a command signal at a single frequency is more efficient and provides better overall communication, the desire is to have a first communication controller monitoring and repeating communications at a first frequency, while a second communication controller monitors and repeats communications at a second frequency. Therefore, when the first communication controller receives a second identification signal, communications may be sent between the first communication controller and second communication controller to have the first communication controller monitor and repeat at a first frequency, while the second communication controller monitors and repeats at a second frequency.

If the first communication controller does not receive a second identification signal, the first communication controller continues operating in the second mode. Because another communication device is not detected that can repeat a control signal, the first communication controller continues to monitor and repeat signals at both the first frequency and the second frequency.

If the first communication controller receives the second identification signal, then at step 412 the first communication controller switches to operating in a third mode. In the third mode, the first communication controller selects one of the first frequency or second frequency to monitor and repeat. The selection may be based on communications with the second communication controller that are broadcasted with the second identification signal. Based on the communications, the first communication controller selects one of the first frequency or second frequency while the second communication controller selects the other of the first frequency or second frequency. As a result, each controller repeats control signals at different frequencies. While described in relation a first frequency and a second frequency, additional frequencies may also be provided. To this end, the selection of the first communication controller and second communication controller to repeat at a first frequency, second frequency, other frequency, etc. may be a determination based on the data and information obtained with the identification signals. In particular, to make determinations related to how each communication controller functions, considerations may be made regarding the type of communication equipment each communication controller has available, access to each frequency by each of the communication controllers, location of each communication controller, or the like. Determinations may be made utilizing lookup tables, mathematical models, mathematical functions, algorithms, artificial intelligence algorithms, machine learning algorithms, or the like. In this manner, each communication controller is utilized to improve communication at each frequency.

Once the first communication controller switches to operating in a third mode, the first communication controller continues to determine whether to switch from the third operating mode back to the first mode. In particular, whether the first communication controller is operating as a repeater in a second operating mode or third operating mode, the first communication controller switches back to the first mode when it needs to operate for its intended purpose.

At step 414, a determination is made whether to switch from a third operating mode back to the second operating mode. After switching to the third operating mode where only one frequency is monitored for repeating, the first communication controller continues to broadcast the first identification signal for a second communication controller, and monitors for the second identification signal from the second communication controller. While improved functionality is provided by having one communication controller monitor and repeat at a first frequency and having the other communication controller monitor and repeat at a second frequency, if the other communication controller stops functioning as a repeater for any reason, having a single communication controller monitoring both at the first frequency and second frequency is better than only monitoring and repeating in a single frequency.

In one example, the determination is made as a result of the second communication controller communicating a message that the second communication controller will stop functioning as a repeater at a predetermined time. When the second communication controller switches modes from a third mode to a first mode based on a trip plan, distance to a location, a determined location, a determined milage, etc. the second communication controller can communicate that time, location, event, etc. to the first communication controller. Alternatively, the first communication controller may also utilize a trip plan, distance to a location, a determined location, a determined milage, etc. to determine when the second communication controller will stop functioning as a repeater.

In yet another example, the first communication controller continues monitoring for the second identification signal from the second communication controller and if a determined period occurs without receiving the second identification signal, the first communication controller may automatically switch from the third mode to the second mode. The second communication controller may stop functioning as a repeater for any reason, including loss of power, receiving an input that places the second communication controller into a first mode, damage, malfunctioning, or the like. When the second communication controller stops functioning as a repeater it stops broadcasting the second identification signal, such that when the determined period lapses without receiving the second identification signal, the first communication controller can determine the second communication controller is no longer functioning as a repeater. At this time the first vehicle switches from the third mode to the second mode to monitor and repeat communications signals at both the first frequency and second frequency.

In one example, the determined period may be thirty seconds, one minute, five minutes, or the like. In another example, the second communication controller broadcasts the second identification signal once every fifteen seconds, and the determined period is thirty seconds. In this manner, if the second communication controller is functioning as a repeater, the first communication controller should have an opportunity to receive two identification signals during the determined period. As a result, when two or more communication controllers are presented, the two or more communication controllers may work together to monitor and repeat control signals along a vehicle system. By obtaining and transmitting identification signals, the improved functionality of having one repeater dedicated for each frequency is achieved while ensuring at least one repeater is presented for more than one frequency when another communication controller stops functioning as a repeater.

In one or more example embodiments, a system is provided that may include a first communication controller that may communicate with a vehicle system formed from two or more vehicles. The first communication controller may operate in different modes, including a first mode in which the first communication controller operates to control movement of the vehicle system without repeating any control signals communicated between the vehicles. The first communication controller may also operate in a second mode in which the first communication controller monitors different frequencies for receipt of the control signals, receives and repeats a first control signal of the control signals at a first frequency, and receives and repeats a second control signal of the control signals at a second frequency. The first communication controller may also operate in a third mode in which the first communication controller may monitor the first frequency but not the second frequency for the first control signal, receives the first control signal at the first frequency, and repeats the first control signal at the first frequency.

Optionally, the first communication controller may also communicate a first identification signal to a second communication controller of the vehicle system, and receive a second identification signal from the second communication controller. The first communication controller may additionally, switch from operating in the second mode to the third mode in response to receiving the second identification signal. In one aspect, the first communication controller may also monitor an identification frequency for the second identification signal while the first communication controller operates in the third mode. The first communication controller may switch from operating in the third mode to operating in the second mode in response to not receiving the second identification signal at the identification frequency for a determined period. In one example, the first identification signal may include a first vehicle identification, and the second identification signal may include a second vehicle identification.

Optionally, the system may also include a second communication controller that may communicate with the vehicle system. The second communication controller may operate in different modes, including a first mode in which the second communication controller operates to control movement of the vehicle system without repeating any control signals communicated between the vehicles. The second communication controller may operate in a second mode in which the second communication controller monitors different frequencies for receipt of the control signals, receives and repeats a first control signal of the control signals at a first frequency, and receives and repeats a second control signal of the control signals at a second frequency. The second communication controller may also operate in a third mode in which the second communication controller monitors the second frequency but not the first frequency for the second control signal, receives the second control signal at the second frequency, and repeats the second control signal at the second frequency. In one aspect, the second communication controller may also communicate a second identification signal to the first communication controller, receive a first identification signal from the first communication controller, and switch from operating in the second mode to the third mode in response to receiving the first identification signal. In another aspect, the vehicle system may be a rail vehicle system that includes a first vehicle that includes the first communication controller. In another example, the first communication controller may be part of a wayside device. In yet another example, the first communication controller may also receive operator inputs in the first mode. In one embodiment, the first communication controller may also automatically switch from operating in the second mode or the third mode to operating in the first mode based on receiving the operator inputs.

In one or more example embodiments, a method may be provided that includes operating a first communication controller in a first mode to control movement of a vehicle system formed from two or more vehicles without repeating any control signals communicated between the vehicles. The method may also include operating the first communication controller in a second mode to monitor different frequencies for receipt of the control signals, to receive and repeat a first control signal of the control signals at a first frequency, and to receive and repeat a second control signal of the control signals at a second frequency. The method may also include operating the first communication controller in a third mode to monitor the first frequency but not the second frequency for the first control signal, to receive the first control signal at the first frequency, and to repeat the first control signal at the first frequency.

Optionally, the method may also include communicating, with the first communication controller, a first identification signal to a second communication controller, and receiving, with the first communication controller, a second identification signal from the second communication controller. The method may additionally include switching, with the first communication controller, from operating in the second mode to the third mode in response to receiving the second identification signal. In another aspect, the method may include monitoring, with the first communication controller, an identification frequency for the second identification signal while the first communication controller operates in the third mode, and switching the first communication controller from operating in the third mode to operating in the second mode in response to not receiving the second identification signal at the identification frequency for a determined period. In one example, the method may additionally include monitoring, with the first communication controller, an identification frequency for the second identification signal while the first communication controller operates in the third mode, and continue operating the first communication controller in the third mode when receiving the second identification signal during a determined period. In another example, the method may include receiving, with the first communication controller, operator inputs in a first mode. In yet another example, the method may include automatically switching from the second mode or third mode to the first mode in response to receiving operator inputs.

In one or more example embodiments, a system is provided that may include a first communication controller that may communicate with a vehicle system formed from two or more vehicles. The first communication controller may operate in different modes, the modes including a first mode in which the first communication controller operates to control movement of the vehicle system without repeating any control signals communicated between the vehicles. The modes may also include a second mode in which the first communication controller monitors different frequencies for receipt of the control signals, receives and repeats a first control signal of the control signals at a first frequency, receives and repeats a second control signal of the control signals at a second frequency, and monitors an identification frequency. The modes may additionally include a third mode in which the first communication controller monitors the first frequency but not the second frequency for the first control signal, receives the first control signal at the first frequency, repeats the first control signal at the first frequency, and monitors the identification frequency.

Optionally, the first communication controller may switch from the second mode to the third mode in response to receiving an identification signal in the identification frequency. In one aspect, the first communication controller may repeatedly monitor for an identification signal from a second communication controller in the identification frequency, and switch from the third mode to the second mode after a determined period of not receiving the identification signal. In another aspect, the first communication controller may switch from the second mode or the third mode to the first mode in response to receiving an input from an operator.

In one or more example embodiments a system may be provided that includes a head-of-train controller configured to wirelessly communicate within a rail vehicle such as a train that includes two or more rail vehicles. The head-of-train controller may operate in different modes, the modes including a first mode in which the head-of-train controller may directly or indirectly communicate with an end-of-train device for coordinated control of the rail vehicle, without repeating any control signals communicated between the rail vehicles. In a second mode the head-of-train controller may monitor different frequencies for receipt of the control signals, receive and repeat first control signals of the control signals at a first frequency, and receive and repeat second control signals of the control signals at a second frequency. The head-of-train controller may also operate in the second mode responsive to a determination that the rail vehicle lacks any other head-of-train controllers that are configured to operate to repeat the control signals. A third mode may also be provided in which the head-of-train controller may monitor the first frequency for the first control signal but not to monitor the second frequency, receive the first control signals at the first frequency, and repeat the first control signals at the first frequency. The head-of-train controller may operate in the third mode responsive to a determination of a presence of another head-of-train controller onboard the rail vehicle that may operate to repeat the control signals.

In some example embodiments, the device performs one or more processes described herein. In some example embodiments, the device performs these processes based on processor executing software instructions stored by a computer-readable medium, such as a memory and/or a storage component. A computer-readable medium (e.g., a non-transitory computer-readable medium) is defined herein as a non-transitory memory device. A memory device includes memory space located inside of a single physical storage device or memory space spread across multiple physical storage devices.

Software instructions may be read into a memory and/or a storage component from another computer-readable medium or from another device via the communication interface. When executed, software instructions stored in a memory and/or a storage component cause the processor to perform one or more processes described herein. Additionally or alternatively, hardwired circuitry may be used in place of or in combination with software instructions to perform one or more processes described herein. Thus, embodiments described herein are not limited to any specific combination of hardware circuitry and software.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

In one embodiment, the communication system may have a local data collection system deployed that may use machine learning to enable derivation-based learning outcomes. The communication system may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and behavior analytics, and the like.

In one embodiment, the communication system may include a policy engine that may apply one or more policies. These policies may be based at least in part on characteristics of a given item of equipment or environment. With respect to control policies, a neural network can receive input of a number of environmental and task-related parameters. These parameters may include an identification of a determined trip plan for a vehicle group, data from various sensors, and location and/or position data. The neural network can be trained to generate an output based on these inputs, with the output representing an action or sequence of actions that the vehicle group should take to accomplish the trip plan. During operation of one embodiment, a determination can occur by processing the inputs through the parameters of the neural network to generate a value at the output node designating that action as the desired action. This action may translate into a signal that causes the vehicle to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The maintenance system may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models is obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes, which may be weighed relative to each other.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed:

1. A system comprising:

a first communication controller configured to communicate with a vehicle system that includes two or more vehicles, the first communication controller configured to operate in different modes, the modes including:

a first mode in which the first communication controller operates at least one vehicle in the vehicle system without repeating any control signals communicated between the vehicles;

a second mode in which the first communication controller monitors different frequencies for receipt of the control signals, receives and repeats a first control signal of the control signals at a first frequency, and receives and repeats a second control signal of the control signals at a second frequency, and a third mode in which the first communication controller monitors the first frequency for the first control signal but does not monitor the second frequency for the first control signal, receives the first control signal at the first frequency, and repeats the first control signal at the first frequency.

2. The system of claim 1, wherein the first communication controller is configured to:

communicate a first identification signal to a second communication controller of the vehicle system;

receive a second identification signal from the second communication controller; and switch from operating in the second mode to the third mode in response to receiving the second identification signal.

3. The system of claim 2, wherein the first communication controller is configured to:

monitor an identification frequency for the second identification signal while the first communication controller operates in the third mode, the first communication controller configured to switch from operating in the third mode to operating in the second mode in response to not receiving the second identification signal at the identification frequency for a designated period.

4. The system of claim 2, wherein the first identification signal includes a first vehicle identification, and the second identification signal includes a second vehicle identification.

5. The system of claim 1, further comprising:

a second communication controller configured to communicate with the vehicle system, the second communication controller configured to operate in different modes, the modes including:

a fourth mode in which the second communication controller operates to control at least one vehicle in the vehicle system without repeating any of the control signals communicated between the vehicles, a fifth mode in which the second communication controller monitors the different frequencies for receipt of the control signals, receives and repeats the first control signal of the control signals at the first frequency, and receives and repeats the second control signal of the control signals at the second frequency, and a sixth mode in which the second communication controller monitors the second frequency for the second control signal but does not monitor the first frequency, receives the second control signal at the second frequency, and repeats the second control signal at the second frequency.

6. The system of claim 5, wherein the second communication controller is further configured to:

communicate a second identification signal to the first communication controller;

receive a first identification signal from the first communication controller; and switch from operating in the second mode to the third mode in response to receiving the first identification signal.

7. The system of claim 1, wherein the vehicle system is a rail vehicle system that includes a first vehicle that includes the first communication controller.

8. The system of claim 1, wherein the first communication controller is part of a wayside device.

9. The system of claim 1, wherein the first communication controller is further configured to receive operator inputs in the first mode.

10. The system of claim 9, wherein the first communication controller is further configured to automatically switch from operating in the second mode or the third mode to operating in the first mode based on receiving the operator inputs.

11. A method comprising:

operating a first communication controller in a first mode to control at least one vehicle of a vehicle system that includes two or more vehicles without repeating any control signals communicated between the vehicles;

operating the first communication controller in a second mode to monitor different frequencies for receipt of the control signals, to receive and repeat a first control signal of the control signals at a first frequency, and to receive and repeat a second control signal of the control signals at a second frequency, and operating the first communication controller in a third mode to monitor the first frequency for the first control signal but not to monitor the second frequency, to receive the first control signal at the first frequency, and to repeat the first control signal at the first frequency.

12. The method of claim 11, further comprising, communicating, with the first communication controller, a first identification signal to a second communication controller;

receiving, with the first communication controller, a second identification signal from the second communication controller; and switching, with the first communication controller, from operating in the second mode to the third mode in response to receiving the second identification signal.

13. The method of claim 12, further comprising:

monitoring, with the first communication controller, an identification frequency for the second identification signal while the first communication controller operates in the third mode; and switching the first communication controller from operating in the third mode to operating in the second mode in response to not receiving the second identification signal at the identification frequency for a designated period.

14. The method of claim 12, further comprising:

monitoring, with the first communication controller, an identification frequency for the second identification signal while the first communication controller operates in the third mode; and continue operating the first communication controller in the third mode when receiving the second identification signal during a designated period.

15. The method of claim 11, further comprising:

receiving, with the first communication controller, operator inputs in the first mode.

16. The method of claim 11, further comprising:

automatically switching from the second mode or third mode to the first mode in response to receiving operator inputs.

17. A system comprising:

a first communication controller configured to communicate with a vehicle system that includes two or more vehicles, the first communication controller configured to operate in different modes, the modes including:

a first mode in which the first communication controller operates to control at least one vehicle of the vehicle system without repeating any control signals communicated between the vehicles, a second mode in which the first communication controller monitors different frequencies for receipt of the control signals, receives and repeats a first control signal of the control signals at a first frequency, receives and repeats a second control signal of the control signals at a second frequency, and monitors an identification frequency; and a third mode in which the first communication controller monitors the first frequency for the first control signal but not the second frequency, receives the first control signal at the first frequency, repeats the first control signal at the first frequency, and monitors the identification frequency.

18. The system of claim 17, wherein the first communication controller is configured to:

switch from the second mode to the third mode in response to receiving an identification signal in the identification frequency.

19. The system of claim 17, wherein the first communication controller is configured to:

repeatedly monitor for an identification signal from a second communication controller in the identification frequency; and switch from the third mode to the second mode after a designated period of not receiving the identification signal.

20. The system of claim 17, wherein the first communication controller is configured to switch from the second mode or the third mode to the first mode in response to receiving an input from an operator.

* * * * *